United States Patent [19]

Eichelsbacher et al.

[11] Patent Number: 4,599,092

[45] Date of Patent: Jul. 8, 1986

[54] PROCESS FOR THE GASIFICATION OF CARBONACEOUS AGGLOMERATES IN A FIXED BED REACTOR

[75] Inventors: Michael Eichelsbacher, Mainz; Rudolph Kohlen, Wehrheim; Rainer Reimert, Idstein; Carl Hafke, Frankfurt; Wolfgang Schäfer, Bottrop, all of Fed. Rep. of Germany

[73] Assignee: Ruhrgas Aktiengesellschaft, Essen, Fed. Rep. of Germany

[21] Appl. No.: 559,725

[22] Filed: Dec. 9, 1983

[30] Foreign Application Priority Data

Dec. 9, 1982 [DE] Fed. Rep. of Germany ..... 3245567

[51] Int. Cl.[4] ..... C10J 3/02; C10J 3/30

[52] U.S. Cl. ..... 48/197 R; 48/86 R; 48/206; 406/146; 414/217

[58] Field of Search ..... 48/202, 206, 197 R, 48/86 R, DIG. 4, 209; 414/217; 406/146

[56] References Cited

U.S. PATENT DOCUMENTS

| | | | |
|---|---|---|---|
| 2,783,096 | 2/1957 | Berg | 406/146 |
| 2,851,401 | 9/1958 | Payne | 414/217 |
| 4,017,269 | 4/1977 | Dutz et al. | 48/86 R |
| 4,057,400 | 11/1977 | Kaimann et al. | 48/86 R |
| 4,260,298 | 4/1981 | Zenz | 406/146 |
| 4,395,166 | 8/1983 | Ulveling | 406/146 |
| 4,426,809 | 1/1984 | Kupfer et al. | 48/86 R |

FOREIGN PATENT DOCUMENTS 1506699 4/1978 United Kingdom .

OTHER PUBLICATIONS

Halligan et al., "Synthesis Gas from Bovine Waste", Industrial and Engineering Chemistry, Process Design and Development, vol. 14, No. 1, pp. 64–69, (Jan. 1975).

*Primary Examiner*—Barry S. Richman
*Assistant Examiner*—Joye L. Woodard
*Attorney, Agent, or Firm*—Beall Law Offices

[57] ABSTRACT

A process for the gasification of carbonaceous agglomerates in a reactor at a pressure of the range of 5 to 150 bar. The agglomerates are fed into said reactor from a storage zone located above the reactor and form a fixed bed in the reactor, in which they slowly descend when gasified. At least two gasification agents selected from the group consisting of oxygen, air, steam and carbon dioxide are introduced into said reactor through the bottom and rise through said fixed bed. Solid ash or liquid slag is discharged below said fixed bed and a steam-containing product gas is tapped from the reactor above said fixed bed. In order to minimize or prevent the condensation of steam on the agglomerates in the storage zone, the invention provides for a controlled atmosphere almost entirely free of oxygen and steam which is introduced into the storage zone at a pressure approximately equal to the pressure of the product gas.

9 Claims, 1 Drawing Figure

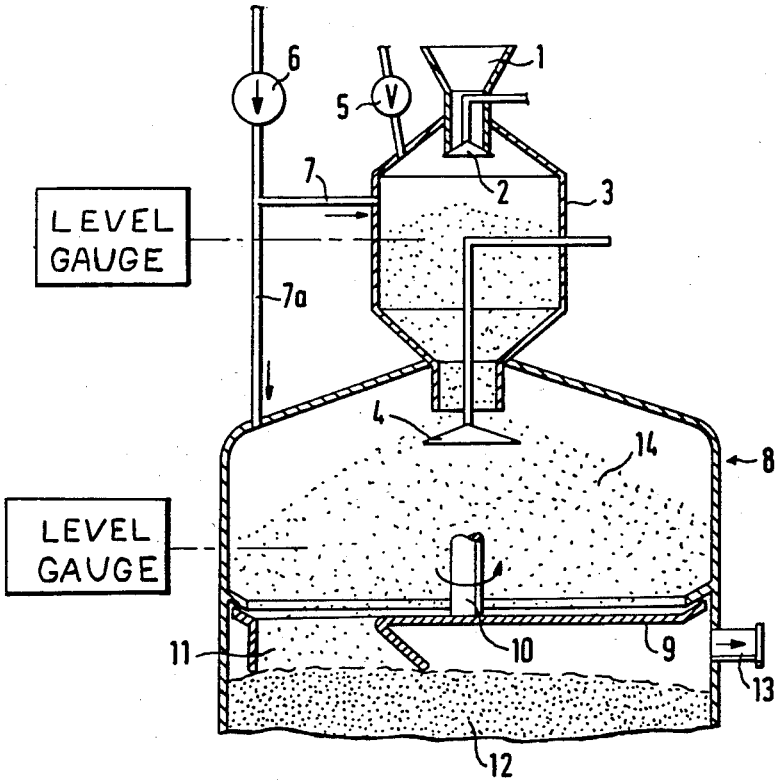
6
5
V
1
7
2
3
LEVEL GAUGE
7a
4
14
8
LEVEL GAUGE
11
10
9
13
12

PROCESS FOR THE GASIFICATION OF CARBONACEOUS AGGLOMERATES IN A FIXED BED REACTOR

BACKGROUND OF THE INVENTION

The present invention relates to a process for the gasification of carbonaceous agglomerates in a reactor at a pressure of preferably 5 to 150 bar. In this process the agglomerates are fed into said reactor from a storage zone located above said reactor and form a fixed bed in the reactor with said agglomerates slowly descending in said fixed bed. At least two gasification agents selected from the group consisting of oxygen, air, steam and carbon dioxide are caused to flow upwardly through said fixed bed, solid ash or liquid slag is discharged below said fixed bed and a product gas having a high steam content is tapped from said reactor above said fixed bed.

The gasification of coarse-grained coal by fixed-bed methods is well known (cf. Ullmann, Enzyklopädie der technischen Chemie, 4th edition (1977), vol. 14, p 383–386). Details of the gasification process producing solid ash can be found in U.S. Pat. Nos. 3,540,867 and 3,854,895 and the provisional West German publication of Specification No. 2,201,278. The gasification process producing liquid slag is explained in British Pat. Nos. 1,507,905; 1,508,671 and 1,512,677. The references quoted herein above describe the gasification process which is also used for the gasification of carbonaceous agglomerates to which the present invention relates.

SUMMARY OF THE INVENTION

Investigations have shown that problems are encountered when the carbonaceous agglomerates in the storage zone come into extensive contact with the steam-saturated product gas and the steam condenses on the relatively cold agglomerates. The temperature of said agglomerates in the storage zone is generally well below that of the product gas which may be between 300° and 800° C. The condensed steam reduces the cohesion of the agglomerates allowing the agglomerates to soften or even to disintegrate. Hence, the share of fines in the fixed bed increases undesirably and the flow of agglomerates from the storage zone (lock hopper and/or coal distributor) may be impaired or even totally stopped.

In order to overcome the problem referred to hereinabove, the process described herein has been invented to reduce or entirely prevent condensation of steam on the agglomerates in the storage zone. The present invention provides for a controlled atmosphere almost entirely free of oxygen and steam to be introduced into the storage zone at a pressure approximately equal to the pressure of the product gas and having a temperature greater than the dew point of the product gas (approx. 180° C.), thereby reducing contact between the product gas and the agglomerates in the storage zone adequately to prevent steam condensation.

The storage zone in conventional gasifiers is the lock hopper which is located above the gasifier and in which the pressure of the agglomerates, which may include coarse-grained coal, is raised from atmospheric pressure to reactor pressure.

For the fixed-bed gasification process, a coal distributor is often located in the top section of the gasifier below the lock hopper, the coal distributor rotating slowly on a vertical shaft and distributing the coal over the fixed bed through one or several openings. A bed of coarse-grained fuel to be gasified (chiefly carbonaceous agglomerates in the case of the present invention) is formed over the coal distributor. Such rotating coal distributors are described in U.S. Pat. Nos. 3,902,872 and 4,040,800. The present invention provides for the continuous introduction of the controlled atmosphere (hereinafter also called protective gas) into the area of the coal distributor to prevent the condensation of steam on the agglomerates as a result of interaction with the steam-containing product gas prior to distribution. Such controlled introduction of protective gas may be sufficient to prevent product gas from ingressing into the coal distributor zone or even into the lock when the lock is opened. The present invention may, however, also be used to introduce such controlled atmosphere into the lock in addition to the coal distributor zone.

When the lock is to be filled with fresh fuel and must therefore be depressurized, the controlled atmosphere leaving the lock may be recompressed and recycled for renewed use.

The carbonaceous agglomerates used for gasification may be obtained by briquetting, pelleting, extrusion or other means and the main components of said agglomerates may be hard coal, lignite or peat. The strength and the weathering properties of said agglomerates may be improved by the use of binders such as pitch or tar. The production of agglomerates for use in the process is set out e.g. in the U.S. Pat. No. 4,111,665 and in British Pat. Nos. 1,435,089 and 1,439,317. The grain size or diameter of the agglomerates may range from 10 to 80 mm.

The protective gas used may preferably be a dry product gas, nitrogen, carbon dioxide, methane or a combination of any of these gases. If carbon dioxide, nitrogen or methane is used, the protective gas may be released to the environmental atmosphere when the lock is depressurized, since said gases do not contain unacceptably high concentrations of harmful substances.

Details of the process which is the subject of the present invention are described by reference to the drawing.

BRIEF DESCRIPTION OF THE DRAWING

The drawing is a diagrammatic sectional view only of the upper portion of a gasifier for implementing the invented process.

DETAILED DESCRIPTION

When the lock cycle has been started by means of a control signal, such as a signal outputted by a level gauge, a certain quantity of carbonaceous agglomerates to be gasified passes through the inlet hopper 1 into the lock 3 through the open valve 2, discharge valve 4 being closed. After having charged the lock 3 at atmospheric pressure, valve 2 is closed and protective gas from compressor 6 through pipe 7 is introduced into the lock 3, with vent valve 5 in the closed position. When the pressure in the lock 3 has approximately risen to the pressure level in the reactor 8, valve 4 is opened and the fuel is discharged from the lock 3 to the coal distributor zone 9. The distributor 9 consists chiefly of a dish-shaped disk mounted in an appropriate manner not described herein and rotating around a vertical shaft 10. Said distributor 9 has one or several openings 11 through which the carbonaceous agglomerates, eventually together with any coarse-grained coal, are continuously distributed over the fixed bed 12 of the gasifier.

The product gas rises through and from the fixed bed and is tapped through the product gas tap 13. To prevent unacceptably high concentrations of product gas from entering the fuel bed 14 above the distributor 9, protective gas is continuously introduced by the compressor 6 though pipe *7a* into the bed 14, said protective gas also flowing to tap 13.

When the lock 3 must be depressurized to charging, with valve 4 being closed, the protective gas is discharged through the open valve 2. Said protective gas may be returned to the compressor 6, if desired.

It is apparent that if the protective gas is continuously introduced into the gasifier through pipe *7a*, the flow of controlled atmosphere (protective gas) to the lock 3 through pipe 7 will not be necessary, if relatively small quantities of product gas are allowed to enter into the bed 14 from below when valve 4 is opened. If the quantity of controlled atmosphere introduced through pipe *7a* is sufficient, said product gas will quickly be expelled from the coal distributor area and hence no serious deterioration of the strength of the agglomerates will occur.

A small pressure gradient from the lock 3 across the bed 14 to the fixed bed 12 will be produced by the continuous introduction of protective gas through the bed 14 and, when valve 4 is opened, through the lock 3 filled with agglomerates, preventing steam-containing product gas from returning as a result of buoyancy due to free convection.

We claim:

1. In a process for the gasification of carbonaceous fuel in a pressurized reactor having a fuel distributor with a bed of fuel, and a pressure lock above the reactor with inlet and outlet valves, said process comprising the steps of:

providing a fixed bed of fuel in said reactor;

in a first portion of a complete cycle, passing the fuel through the inlet valve into the pressure lock with the outlet valve between the pressure lock and the fuel distributor being closed;

periodically feeding said fuel in the form of fuel agglomerates from the pressure lock through the open outlet valve into the fuel distributor disposed in said reactor above said fixed bed, while maintaining the inlet valve closed during another portion of the cycle and with said fuel distributor distributing said agglomerates onto said fixed bed;

continuously causing gasification agents to flow upwardly through said fixed bed to gasify the agglomerates and produce a product gas having a high content of steam throughout the complete cycle;

continuously tapping, through a tap, the product gas having a high content of steam from the reactor above said fixed bed and below said fuel distributor throughout the complete cycle;

intermittently introducing a controlled atmosphere substantially free of steam and oxygen into said pressure lock; and wherein the improvement includes, continuously introducing a controlled atmosphere directly into the fuel distributor without passing through the pressure lock during gasification of the agglomerates throughout the complete cycle sufficiently for maintaining substantially only said controlled atmosphere in said fuel distributor at a pressure sufficient to produce a pressure gradient from the lock across the bed of the fuel distributor to the fixed bed of the reactor to prevent substantial contact between said steam containing product gas and said agglomerates in said fuel distributor and sufficiently for flowing the controlled atmosphere from the fuel distributor to the tap.

2. A process according to claim 1, wherein the controlled atmosphere is selected from the group consisting of dry product gas, nitrogen, carbon dioxide, methane, and a mixture of any of said gases.

3. A process according to claim 1, wherein the controlled atmosphere is dry product gas.

4. A process according to claim 1, wherein the controlled atmosphere is methane.

5. A process according to claim 1, wherein, the improvement further comprises, the temperature of the controlled atmosphere introduced is higher than the dew point of the product gas (approx. 180° C.).

6. A process according to claim 5, wherein said agglomerates to be gasified are briquettes, pellets or extruded material.

7. A process according to claim 1, wherein said agglomerates to be gasified are briquettes, pellets or extruded material.

8. A process according to claim 1, wherein said process is initiated by the signal of a level gauge located in the pressure lock.

9. A process for the gasification of carbonaceous fuels according to claim 1, wherein the size of the agglomerates is in the range from 10 to 80 mm.

* * * * *